US007758200B2

(12) United States Patent
Tuan

(10) Patent No.: US 7,758,200 B2
(45) **Date of Patent: *Jul. 20, 2010**

(54) RESPONSIVE LED MODULE UNIT

(76) Inventor: Wei-Jei Tuan, P.O. Box 166-13, Taipei (TW) 115

( * ) Notice: Subject to any disclaimer, the term of this patent is extended or adjusted under 35 U.S.C. 154(b) by 0 days.

This patent is subject to a terminal disclaimer.

(21) Appl. No.: 12/222,832

(22) Filed: Aug. 18, 2008

(65) Prior Publication Data

US 2010/0039802 A1 Feb. 18, 2010

(51) Int. Cl.
*F21V 21/08* (2006.01)

(52) U.S. Cl. ..... 362/103; 362/249.02; 362/295; 362/394; 362/570

(58) Field of Classification Search ..... 362/103, 362/105–106, 249.05, 295, 394, 555, 570
See application file for complete search history.

(56) References Cited

U.S. PATENT DOCUMENTS 6,354,712 B1 * 3/2002 Anteby ..... 362/103
7,267,452 B2 * 9/2007 Esses ..... 362/103

* cited by examiner

*Primary Examiner*—Jason Moon Han

(57) ABSTRACT

A responsive light emitting diode (LED) module unit includes a control unit (1), a light emitting device (2), and a pouch (5) for enclosing said control unit (1) and said light emitting device (2) therein. Said control unit (1) has rigid plastic housing (15) encloses a printed circuit board (PCB) (11), a battery (12), a ball-rolling switch (14), and an integrated circuit (IC) processor (16). Said light emitting device (2) has a membrane circuit (3), and a plurality of LEDs (4) to emit light. Said pouch (5) is composed of a soft polycarbonate or polyvinyl chloride base (51) and a soft polycarbonate or polyvinyl chloride cover (52) with surface decoration patterns as their perimeters sealed by high frequency wave for receiving said control unit (1) and said LEDs (4), further the pouch is coupled to an upper surface of an object (6).

13 Claims, 14 Drawing Sheets

RESPONSIVE LED MODULE UNIT

FIELD OF THE INVENTION

The present invention is related to a module emitting light, particularly to a module light emission is responsive to feeble vibration.

BACKGROUND OF THE INVENTION

Light emitting diode (LED) is gradually minimized in size as soon as semiconductor manufacturing is developed into a mature industrial standard. Even upstanding neon light placards on roadside are replete with shining newly blue LEDs. Persons are accustomed to light emissions from LED. Such as garments, trousers worn by us easily coupled with modules emitting light.

Module emitting light occupied space smaller than ever, but a better shinning effect may be shown to arouse people's interest. However, module emitting light, designed though with minimized space-occupied, still has some drawbacks as following:

1. Light emission is shown within a limited scope.
2. Light emission shows monotonous sight, likely a secluded spot.
3. Light emission is not responsive to module emitting light activation and synchronization, enables not with the highly saturated colors astonishing visual effects.
4. Laundry may deposit water soaked onto the module unit led to bacteria growth.

On the whole, in use, the conventional module emitting light is subject to the limitations as above. How to increase the scope of light emission with a better light effect, further light emission is responsive to module emitting light activation without any watery deposit or vapor exhalation on the module emitting light is expected from the invention.

SUMMARY OF THE INVENTION

Accordingly, the present invention is to provide a responsive LED module unit includes a control unit (1), a light emitting device (2), and a pouch (5) for enclosing said control unit (1) and said light emitting device (2) therein.

Said control unit (1) includes a printed circuit board (PCB) (11), a battery (12) disposed below the PCB (11) is electrically connected to the PCB (11), a ball-rolling switch (14), and an integrated circuit (IC) processor (16) are disposed on the PCB (11), and all the components as above are built inside a rigid plastic housing (15).

Said light emitting device (2) has a membrane circuit (3) electrically connected to the PCB (11), and a plurality of surface mounted device (SMD) LEDs (4) disposed on a first side of said membrane circuit (3) controlled by said control unit (1) to emit light.

Said pouch (5) is composed of a soft polycarbonate or polyvinyl chloride base (51) and a soft polycarbonate or polyvinyl chloride cover (52) with surface decoration patterns. Both perimeters (53) of said base (51) and said cover (52) are sealed by high frequency wave to form a hollow cavity (54) for receiving and fixing said control unit (1) and said SMD LEDs (4), further the sealed perimeters (53) are coupled to an upper surface of an object (6).

Another embodiment of the invention is a responsive LED module unit includes a control unit (1), at least, one light emitting device (2), and a pouch (5) wraps over said control unit (1), further wraps over said, at least, one light emitting device (2) respectively.

Said control unit (1) includes a printed circuit board (PCB) (11), a battery (12) disposed below the PCB (11) is electrically connected to the PCB (11), a ball-rolling switch (14) and an IC processor (16) are disposed on said PCB (11), and all components as above are enclosed inside a rigid plastic housing (15).

At least, one light emitting device (2) is electrically connected to the PCB (11) by, at least, a set of leading wires (7); light emission of the light emitting device (2) is controlled by the control unit (1).

Said pouch (5) is composed of a soft polycarbonate or polyvinyl chloride base (51), and a soft polycarbonate or polyvinyl chloride cover (52) with surface decoration patterns. Perimeters (53) of said base (51) and cover (52) are sealed by high frequency wave to form a hollow cavity (54) for receiving and fixing said control unit (1) and LEDs (4), further the sealed perimeters (53) is coupled to an upper surface of an object (6).

DETAILED DESCRIPTION OF THE PREFERRED EMBODIMENT OF THE PRESENT INVENTION

Figure 1:
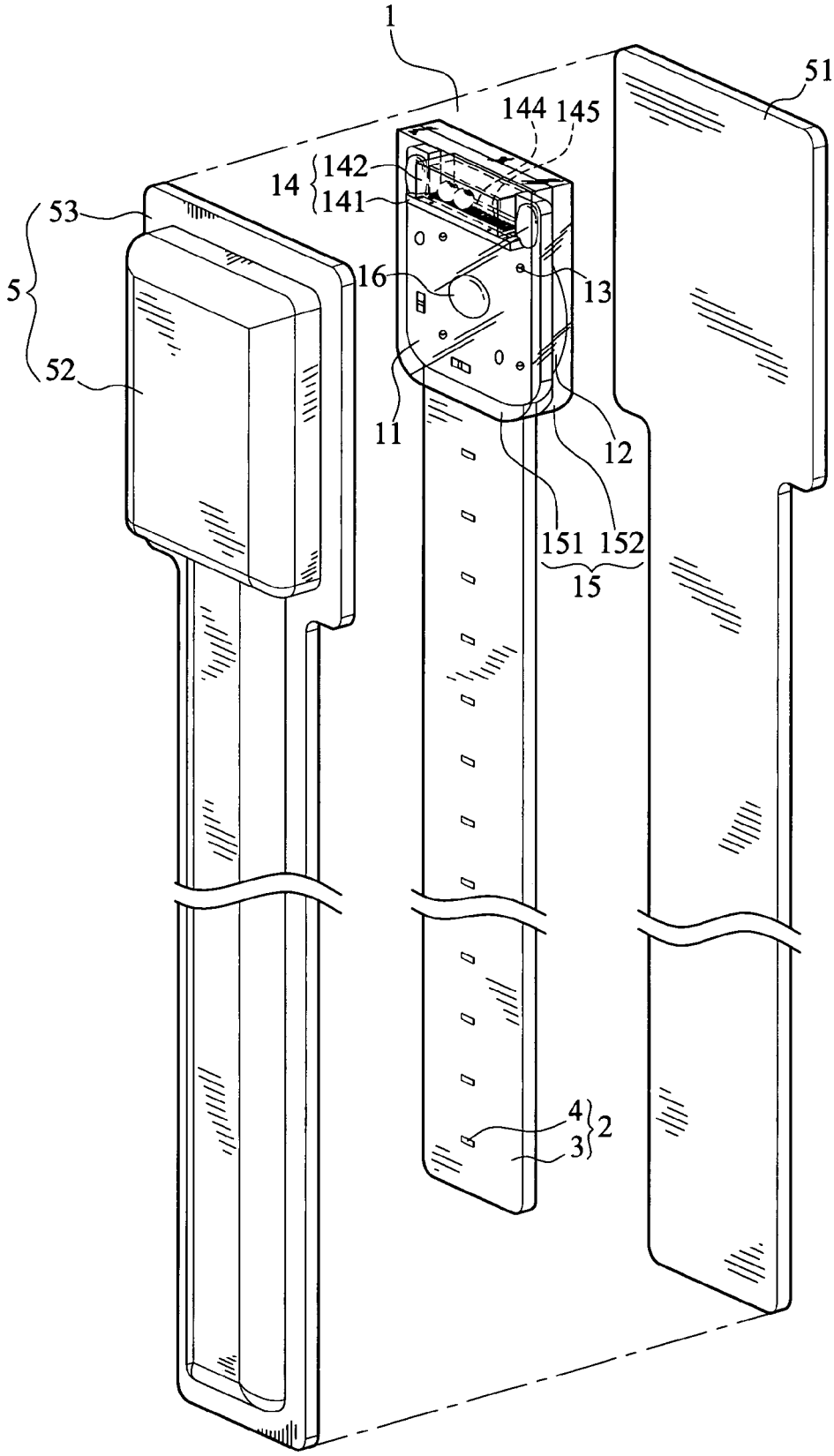
FIG. 1: is an exploded view of the first embodiment of the module of the present invention.
Figure 2:
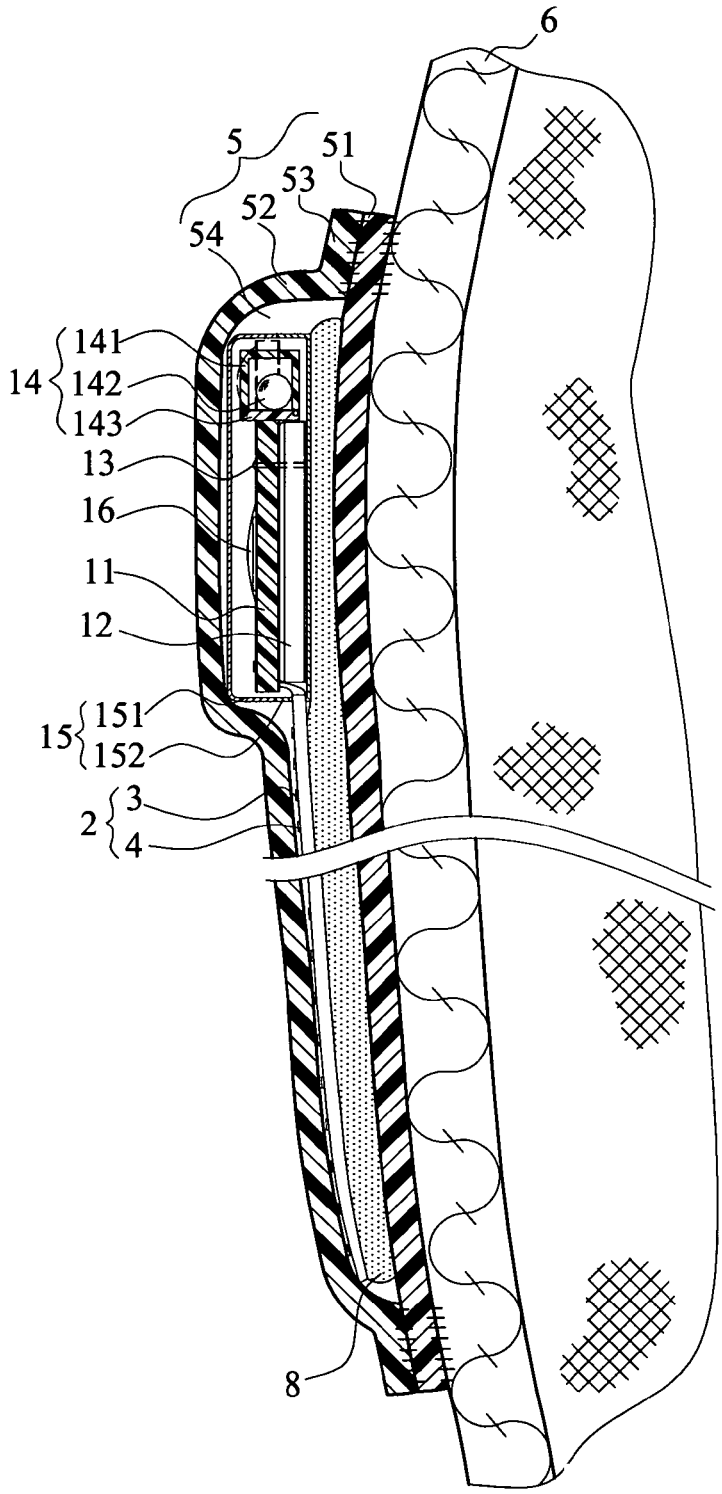
FIG. 2: is a whole cross sectional view of the first embodiment of the present invention.
Figure 3:
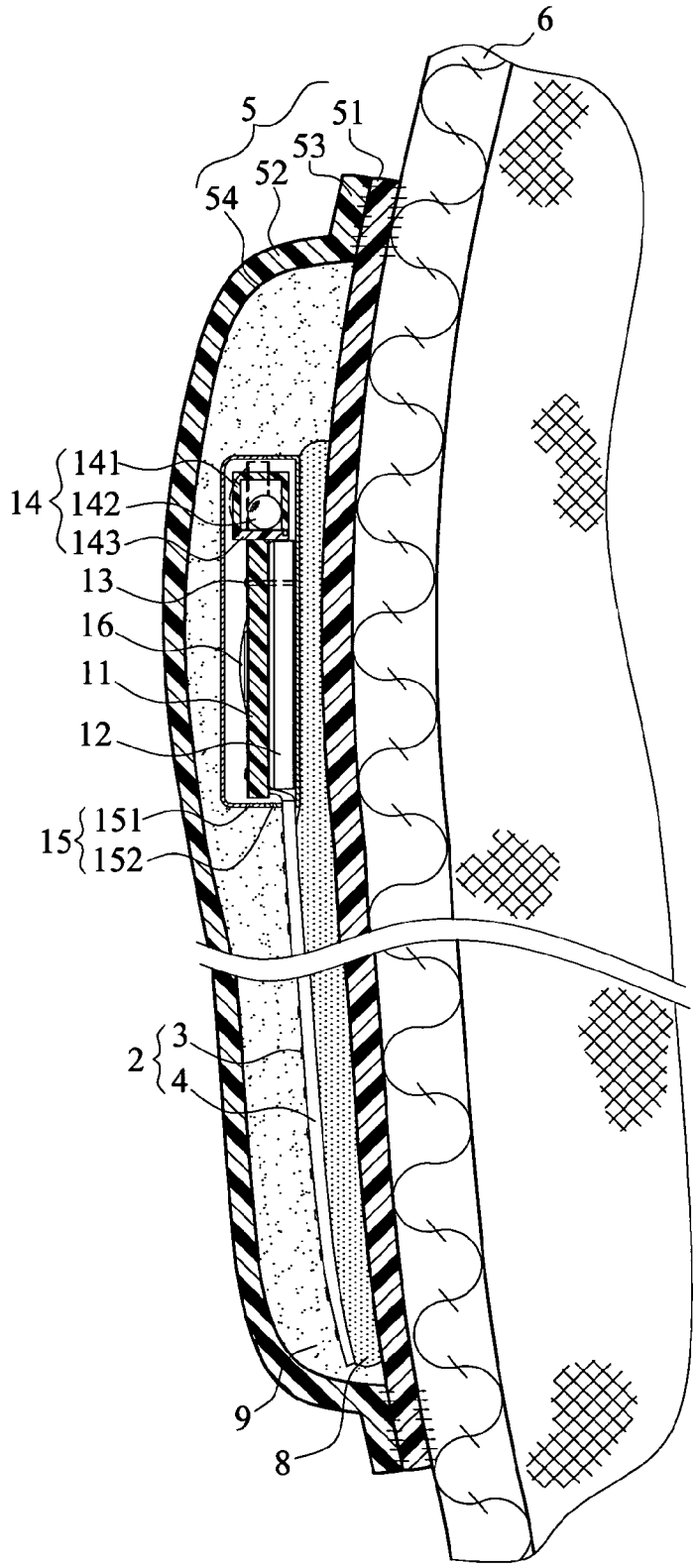
FIG. 3: is a whole cross sectional view of an alternate embodiment of the first embodiment.

The description is described in detail according to the appended drawings hereinafter.

As shown in FIGS. 1~3 and 7, a responsive light emitting diode (LED) module unit comprises: a control unit (1) has a printed circuit board (PCB) (11), a battery (12) disposed below the PCB (11) is electrically connected to the PCB (11), a ball-rolling switch (14), and an integrated circuit (IC) processor (16) are disposed on said PCB (11), and all components as above are enclosed inside a rigid plastic housing (15).

A light emitting device (2) has a membrane circuit (3) electrically connected to the PCB (11), and a plurality of surface mounted device (SMD) LEDs (4) disposed on a first side of said membrane circuit (3) facing outward emits light under control of said control unit (1).

A pouch (5) is composed of a soft polycarbonate or polyvinyl chloride base (51), and a soft polycarbonate or polyvinyl chloride cover (52) with surface decoration pattern. Perimeters (53) of said base (51) and cover (52) are sealed by high frequency wave to form a hollow cavity (54) between the base (51) and the cover (52) for receiving and fixing said control unit (1) and said light emitting device (2) in the cavity (54); further the sealed perimeters (53) are coupled to an upper surface of an object (6).

On the whole, said SMD LEDs (4) combined to said membrane circuit (3) to form said light emitting device (2) to be stretched straight as a long slip.

Furthermore, since said perimeters (53) of said soft polycarbonate or polyvinyl chloride base (51) and said soft polycarbonate or polyvinyl chloride cover (52) are sealed tightly; water vapor or moisture could not permeate through the perimeters (53) into said pouch (5). Even the pouch (5) coupled to an upper surface of the object (6), water vapor or moisture will not permeate through the object (6) into the pouch (5).

Said pouch (5) can also be filled with nitrogen or other inert gas (9), thus the soft polycarbonate or polyvinyl chloride cover (52) to be inflated will not wrinkle. Also the inflated pouch (5) can slow down violent collisions and absorb shocks. Specifically, in the filled pouches (5) preferably comprises nitrogen or inert gas concentration in comparison with ambient air, that is, in the range of 30~70% to thus provide an anti-collision safety mechanism.

In case of the pouch (5) is filled with nitrogen or inert gas concentration with ambient air less than 30%, all the components inside the pouch are exposed to direct collision. Whereby an external force from a collision is exerted against the pouch, accident-preventive measures provided to the pouch is obviously insufficient. As if the nitrogen or inert gas concentration exceeds 70%, degrees of expansion to said soft polycarbonate or polyvinyl chloride cover (52) may come to the end of endurance to the inflated pouch (5). The expanded pouch (5) is easy to be deformed, and may be operated out of shape. Thereby, said nitrogen or inert gas filled inside the pouch is preferably from 30% up to 70% with ambient air.

As above, said control unit (1) and said light emitting device (2) are adhered to the soft polycarbonate or polyvinyl chloride base (51) by fast cure adhesive (8). Or said control unit (1) and said light emitting device (2) are adhered to the soft polycarbonate or polyvinyl chloride base (51) by high frequency wave.

No matter which kind of adhering or sealing methods is used, the control unit (1) will not be slid out of place by gravity. Further, the light emitting device (2) will not move aside with light dim even the pouch (5) is rolled to and fro or folded over or the like. Thereby, it alleviates break down ratio to the pouch (5).

Furthermore, said fast cure adhesive (8) is a high-bond adhesive selected from one of the following: heat melting glue, acrylate adhesive, silicone.

Said ball-rolling switch (14) includes a clamping plate (141) electrically connected to said PCB (11), a housing (142) covers up said clamping plate (141), and, at least, one ball (143) disposed inside the housing (142) is electrically in contact with a superficial circuit laminate on the clamping plate (141). A plurality of pairs of anode, cathode conduction portions (144, 145) are equidistantly arranged on a surface formed as said superficial circuit laminate of the clamping plate (141) in parallel to one another. Said ball (143) subject to feeble vibrations can be rolled across the pairs of conduction portions (144, 145) to conduct electricity as the rolling ball is in contact with both anode and cathode conduction portions (144, 145) at the same time. Thereby, the IC processor (16) is electrified to light the SMD LEDs (4).

Besides, an indentation (111) formed on a distal end of the PCB (11) first clamps the ball-rolling switch (14) in place, the ball-rolling switch (14) is further fixed to the indentation by welding points (146, 147) welded to both left and right ends of the distal end of the PCB (11) adjacent to the indentation (111).

Next, one electrode, for example, an anode of the battery (12) is in contact with the PCB (11), the other electrode, for example, a cathode of the battery (12) is clamped by an L-shaped conduction piece (121) fixed to the PCB (11), both positive and negative currents are conducted to the PCB (11).

As above, said pouch (5) is fixed to an upper surface of an object (6), such as garments, socks made of nylon, by high frequency wave. Or said pouch is fixed to an upper surface of the object, such as garments made of wool or velvet by sewing. (not shown)

Figure 4:
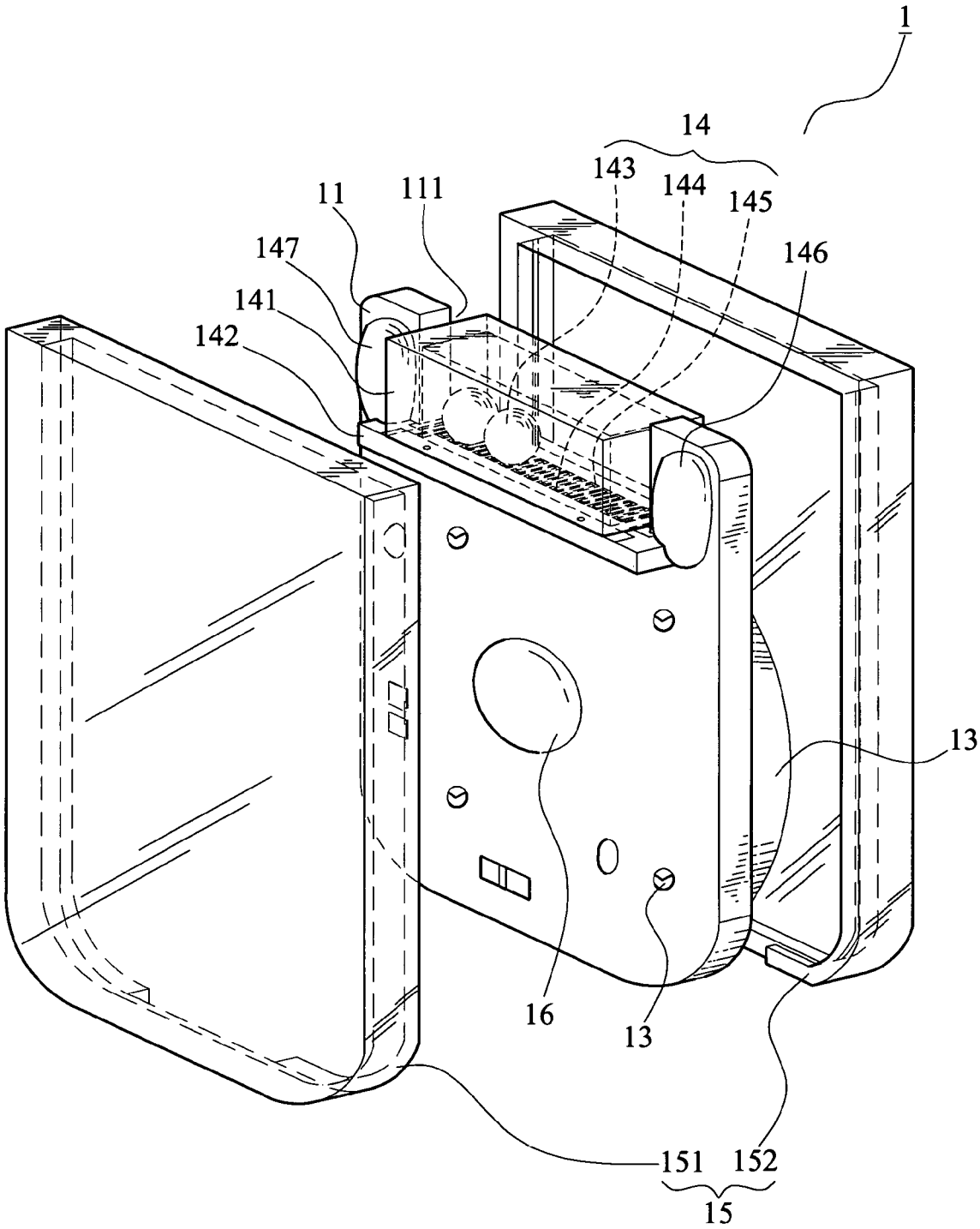
FIG. 4: is an exploded view of the control unit of the present invention.
Figure 5:
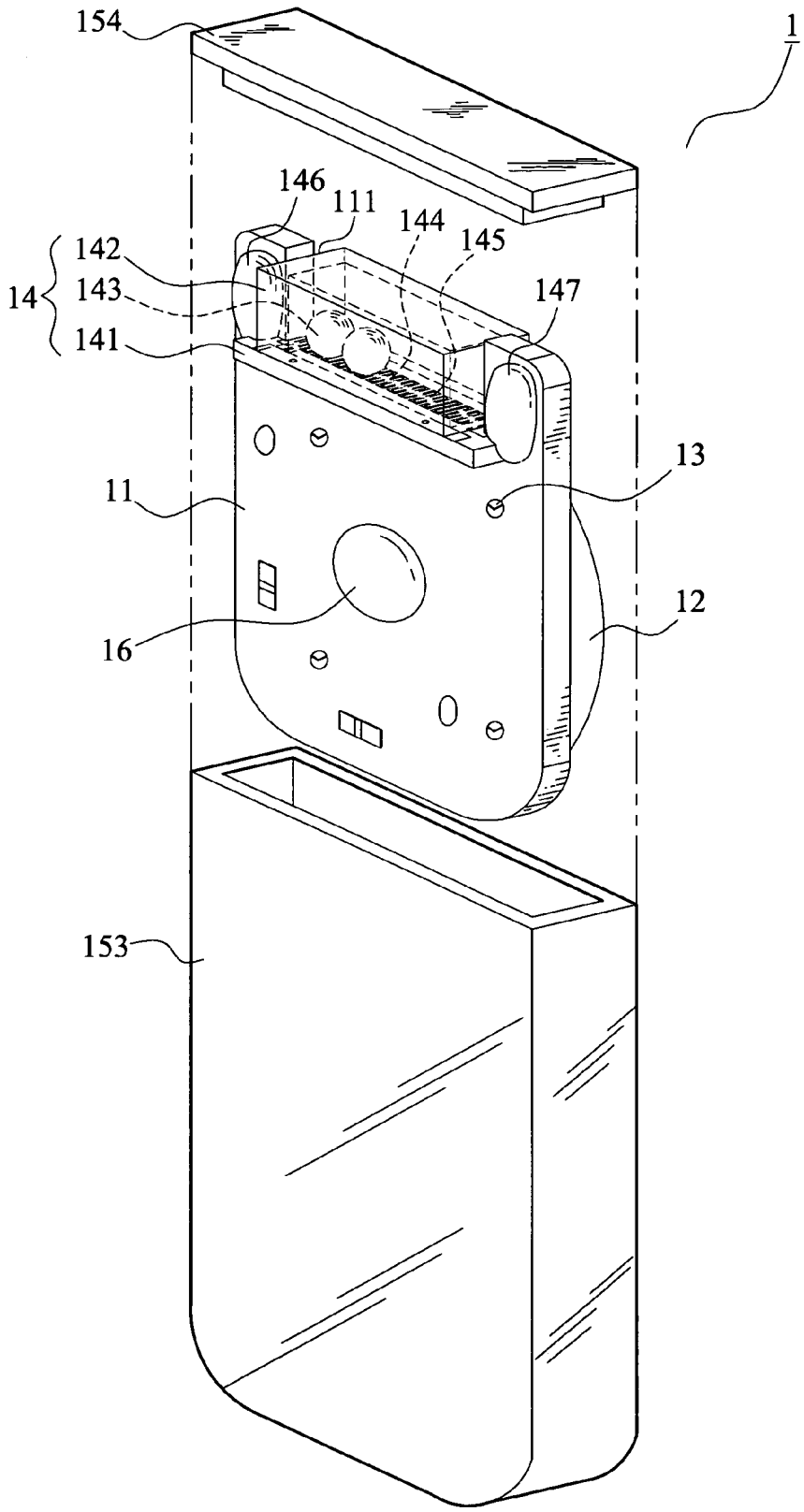
FIG. 5: is an exploded view of an alternate embodiment of said control unit.

As shown in FIGS. 4~5, said rigid plastic housing (15) is composed of a plastic cover (151), and a plastic base (152). The plastic cover (151) is relative to the plastic base (152). Both the plastic cover (151) and the plastic base (152) are molded-to-shape.

Or said rigid plastic housing (15) is composed of a case (153) with a top opening, and a cap (154) for covering said top opening.

Figure 6:
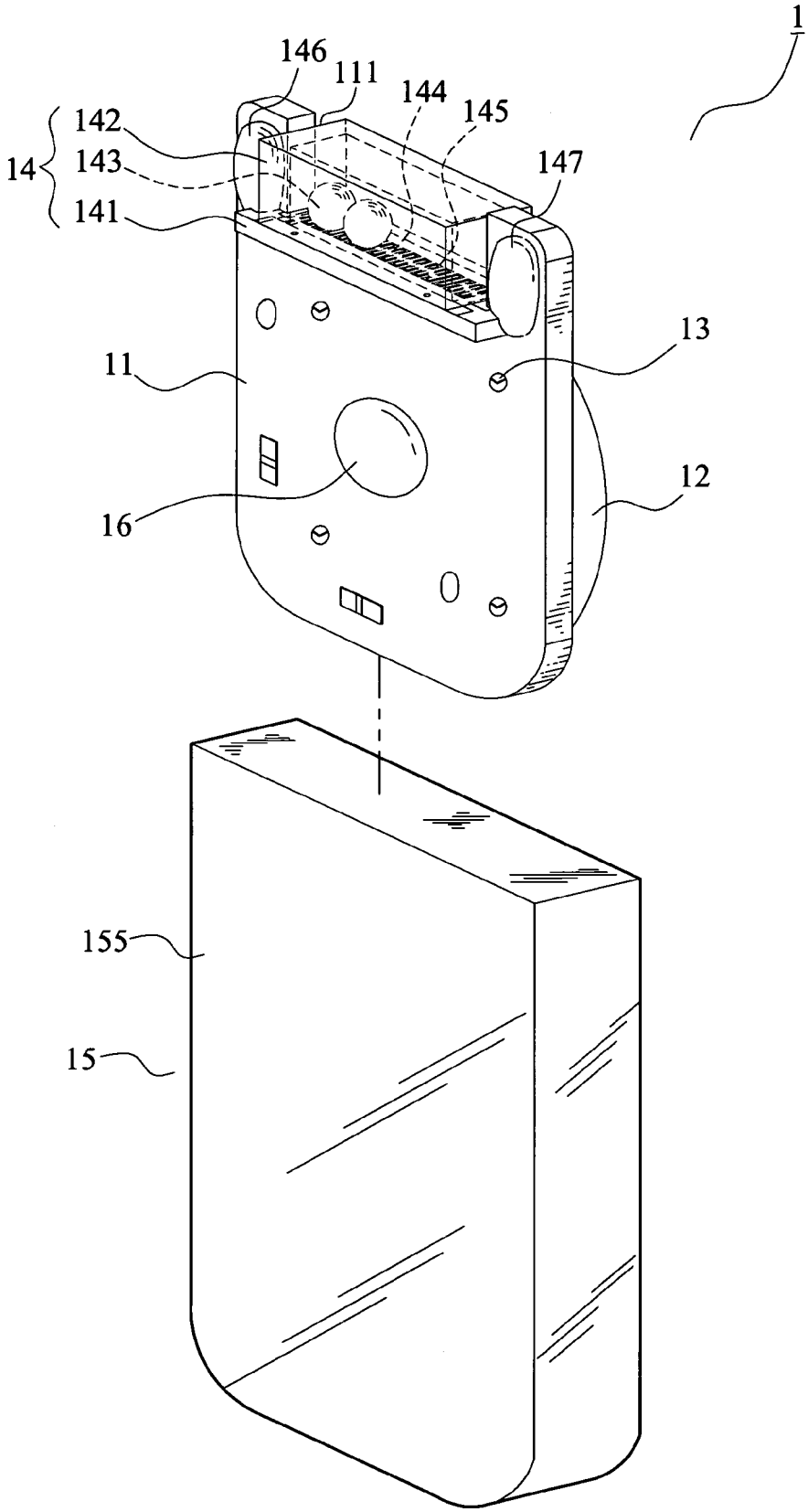
FIG. 6: is a schematic view of the module bind together by epoxy injection.
Figure 7:
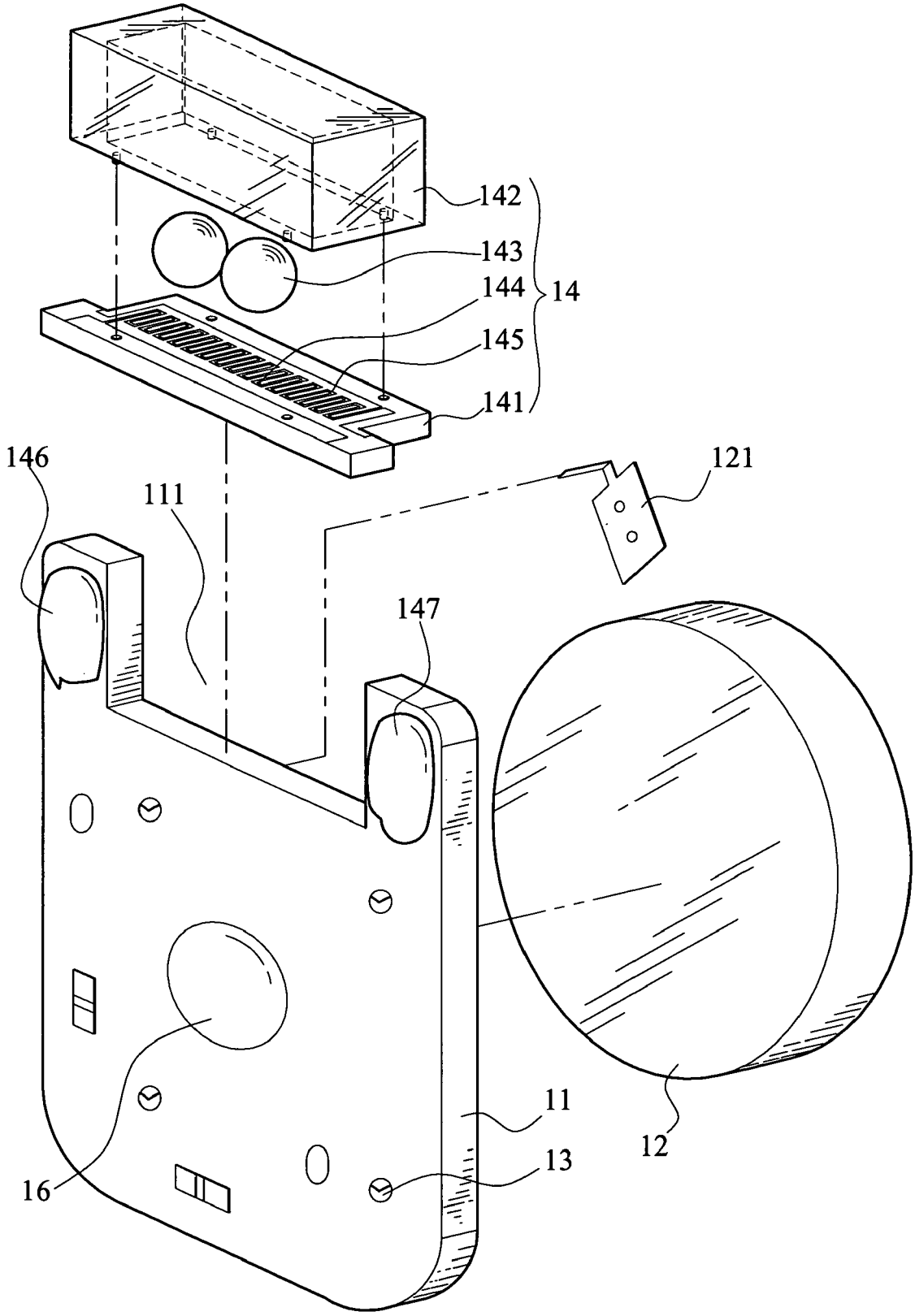
FIG. 7: is an exploded view of components inside the control unit of the present invention.

To facilitate assembling of said rigid plastic housing (15) pervious to light, no matter whether said rigid plastic housing (15) is assembled by the plastic cover (151) and the plastic base (152), or the case (153) and the cap (154); both perimeters of them can be glued with waterproof adhesive, for example, polyurethane adhesive. The glued perimeters are in opposite to each other. Then the perimeters are assembled together as a whole, or they are assembled by high frequency wave. Furthermore, as shown in FIG. 6, the components may bind together by epoxy injection first to wrap over and then the injected epoxy is solidified as said rigid plastic housing (15).

As above, said PCB (11) has several SMD LEDs (4) operated by ball-rolling switch (14) to emit light. SMD LEDs (4) disposed on the PCB (11) can create available, exclusive light effect with added value. Garments, trousers, caps, backpacks, even the teddy bear, spandex knee support, arm support, gloves, caps can be adorned with the pouch (5).

Second Embodiment

Figure 10:
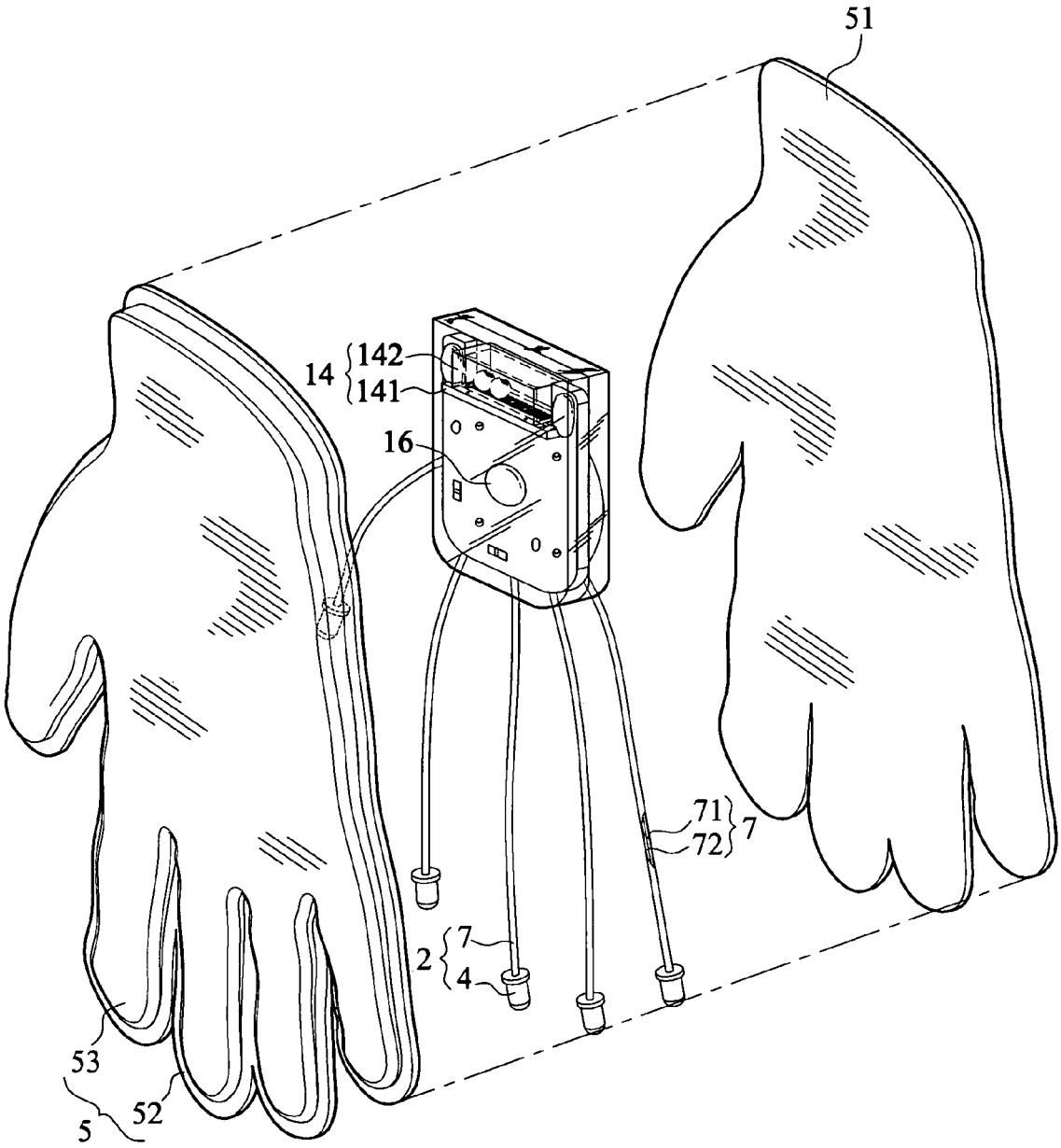
FIG. 10: is an exploded view of the module of the second embodiment of the present invention.
Figure 11:
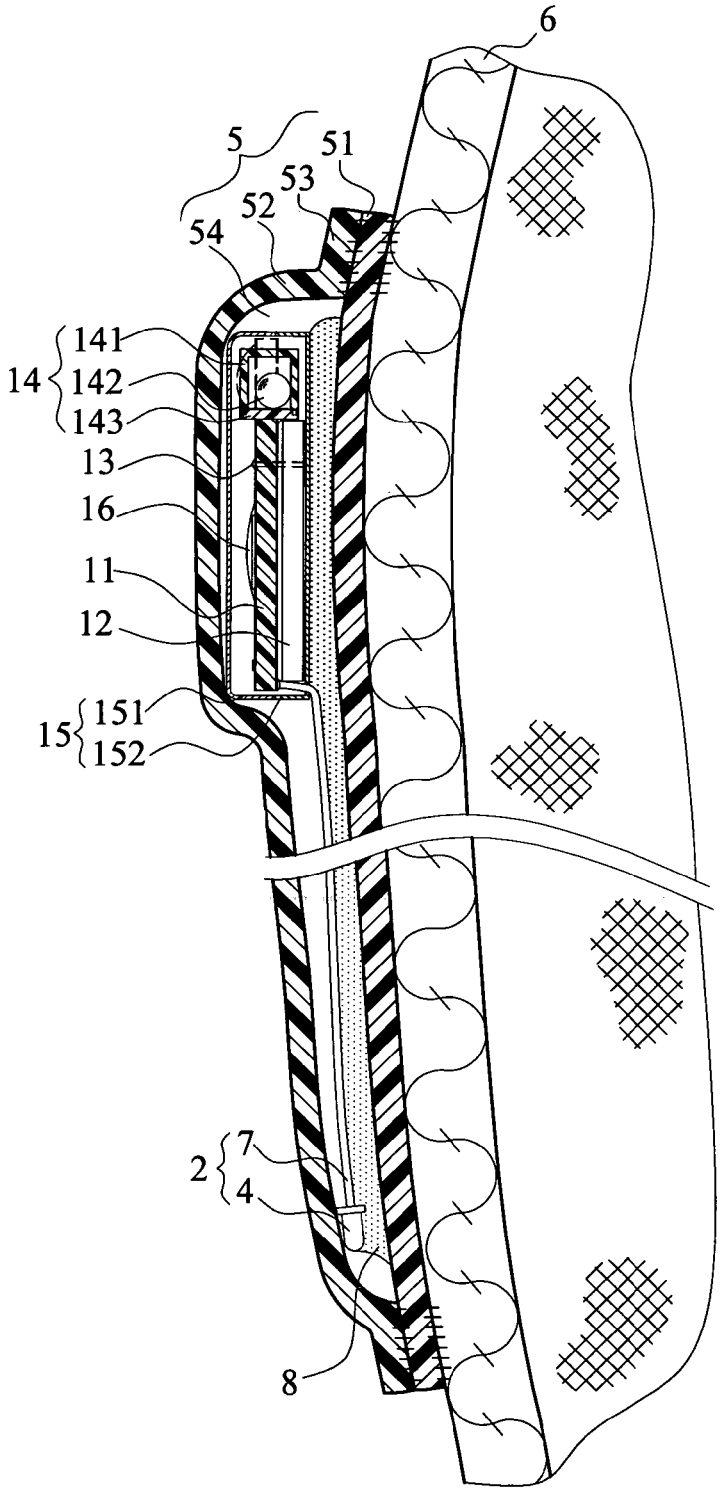
FIG. 11: is a whole cross sectional view of the second embodiment of the present invention.
Figure 12:
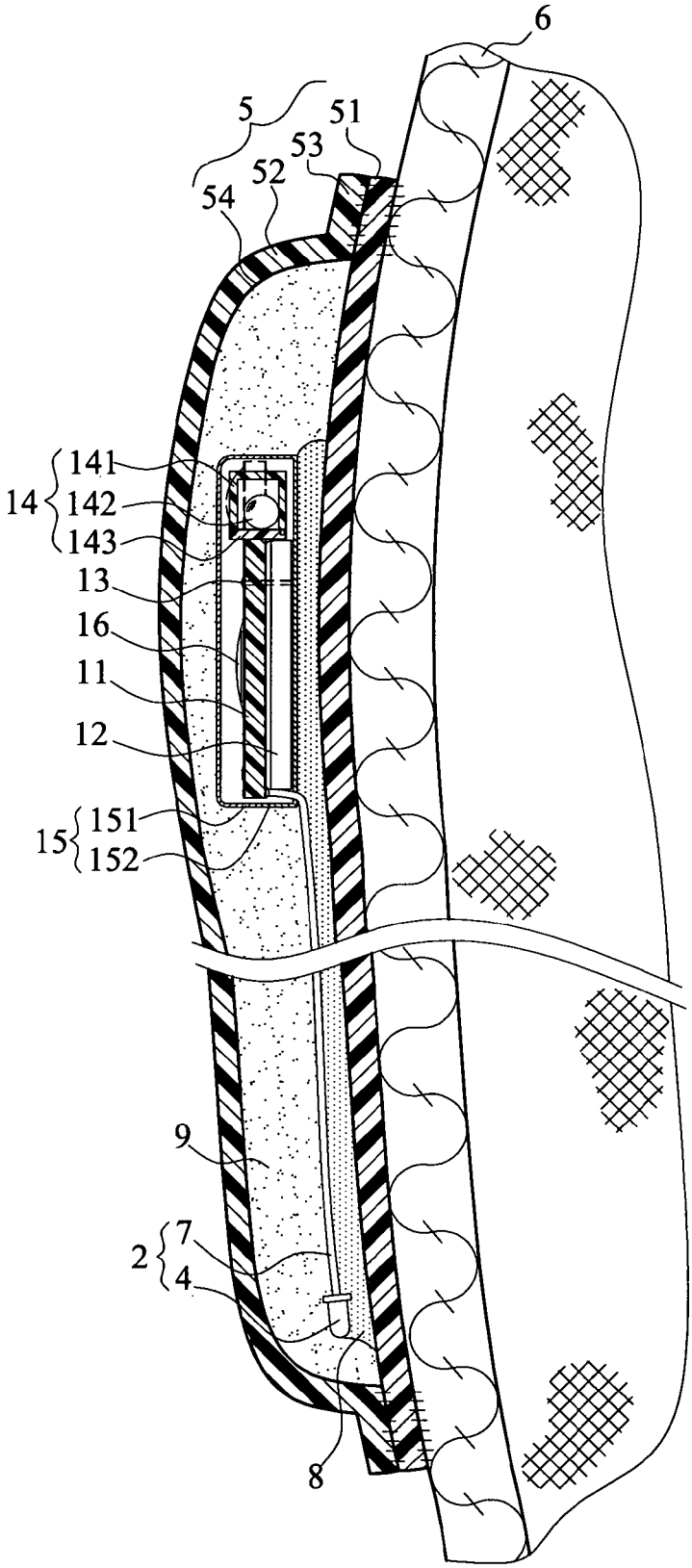
FIG. 12: is a whole cross sectional view of an alternate embodiment of the second embodiment of the present invention.

As shown in FIGS. 10-12, a responsive LED module unit comprises a control unit (1) has a PCB (11), a battery disposed below the PCB (11) is electrically connected to the PCB (11), a ball-rolling switch (14) and an IC processor (16) disposed on the PCB (11); and all the components as above are enclosed inside a rigid plastic housing (15).

At least, one light emitting device (2) has, at least, one set of leading wires (7) is electrically connected to the PCB (11), light emitting diodes (LEDs) (4) operated by the control unit (4) to emit light.

A pouch (5) is composed of a water-tight soft polycarbonate or polyvinyl chloride base (51), and a water-tight soft polycarbonate or polyvinyl chloride cover (52) with surface decoration patterns. Perimeters of said base (51) and cover (52) are sealed through high frequency wave to form a hollow cavity (54) to receive and stably fix the control unit (1) and wrap over each of said light emitting devices (2) between the base (51) and the cover (52) respectively. The sealed perimeters (53) are further coupled to an upper surface of an object (6) by a second side facing inward.

Said light emitting device (2) can show lighting effect distribution by connecting said set of leading wires (7) to said LEDs (4) to become a plurality of separated light emissions. That is not expected by conventional light emitting devices. Further subsequent protracted light emission can be performed in the present invention.

Next, since said perimeters of said base (51) and said cover (52) are sealed tightly, water vapor or moisture could not permeate through the perimeters into the pouch (5). Therefore, once the pouch (5) coupled to said upper surface of said object, water vapor or moisture will not seep through the object (6) to the pouch (5). Even through laundry work, the pouch (5) will not deposit water vapor or moisture thereinside.

Said pouch (5) can also be filled with nitrogen or other inert gas (9), thus the soft polycarbonate or polyvinyl chloride cover (52) to be inflated will not wrinkle. Also the inflated pouch (5) can slow down violent collisions and absorb shocks. Specifically, in the filled pouches (5) preferably comprises nitrogen or inert gas concentration, that is, in the range of 30~70% to thus provide an anti-collision safety mechanism. In addition, in the second embodiment, said pouch (5) once is inflated even can be flared out, from this, a truly three-dimensional pattern can be shown on the cover.

As above, said set of leading wires (7) consist of leading wires (71, 72) conducting positive, negative currents separately but both electrically connected to the LEDs (4). Alternatively, the LEDs (4) are required connected to the control unit (1) locations different from one another to form separate light emissions.

Figure 14:
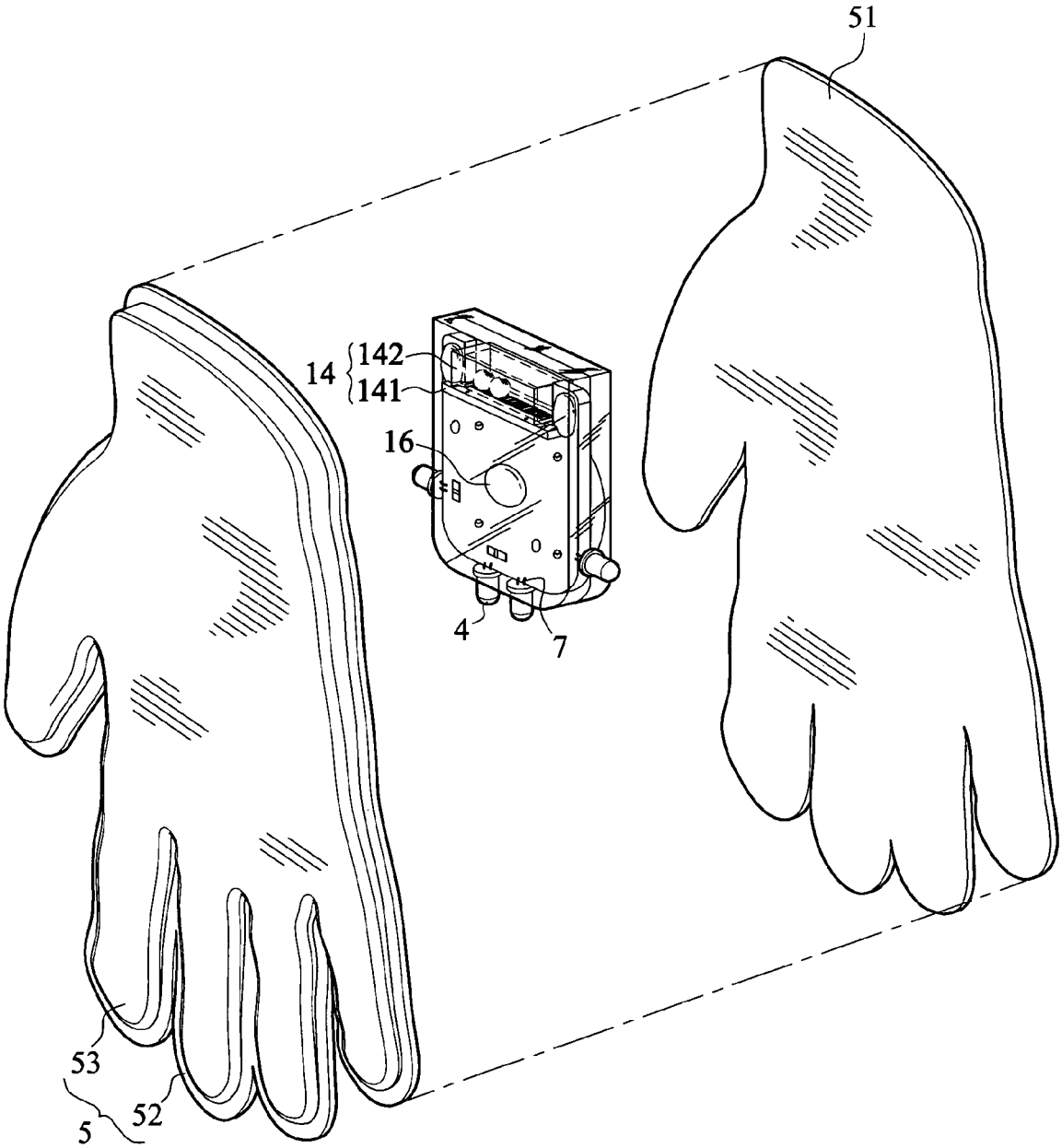
FIG. 14: is an exploded view of another embodiment of the second embodiment.

In addition, as shown in FIG. 14 an exploded view of another embodiment of the second embodiment is illustrated. LEDs are directly coupled to said perimeter of said rigid plastic housing (15) and electrified by the control unit. The leading wires (7) are extended inside the rigid plastic housing (15). As above, said leading wires (7) are used as lead-in wires inside said rigid plastic housing (15) only, said LEDs (4) coupled to a perimeter of said rigid plastic housing (15). While said leading wires (7) are used as lead-out wires outside said rigid plastic housing, said LEDs (4) separately connected to the rigid plastic housing as far as each pair of the leading wires extended in between. (as shown in FIG. 10)

Such as linear materials, and lengths of said leading wires (7) can decide which kinds of light emission, or locations of LEDs (4) to create variable light distributions.

Figure 8:
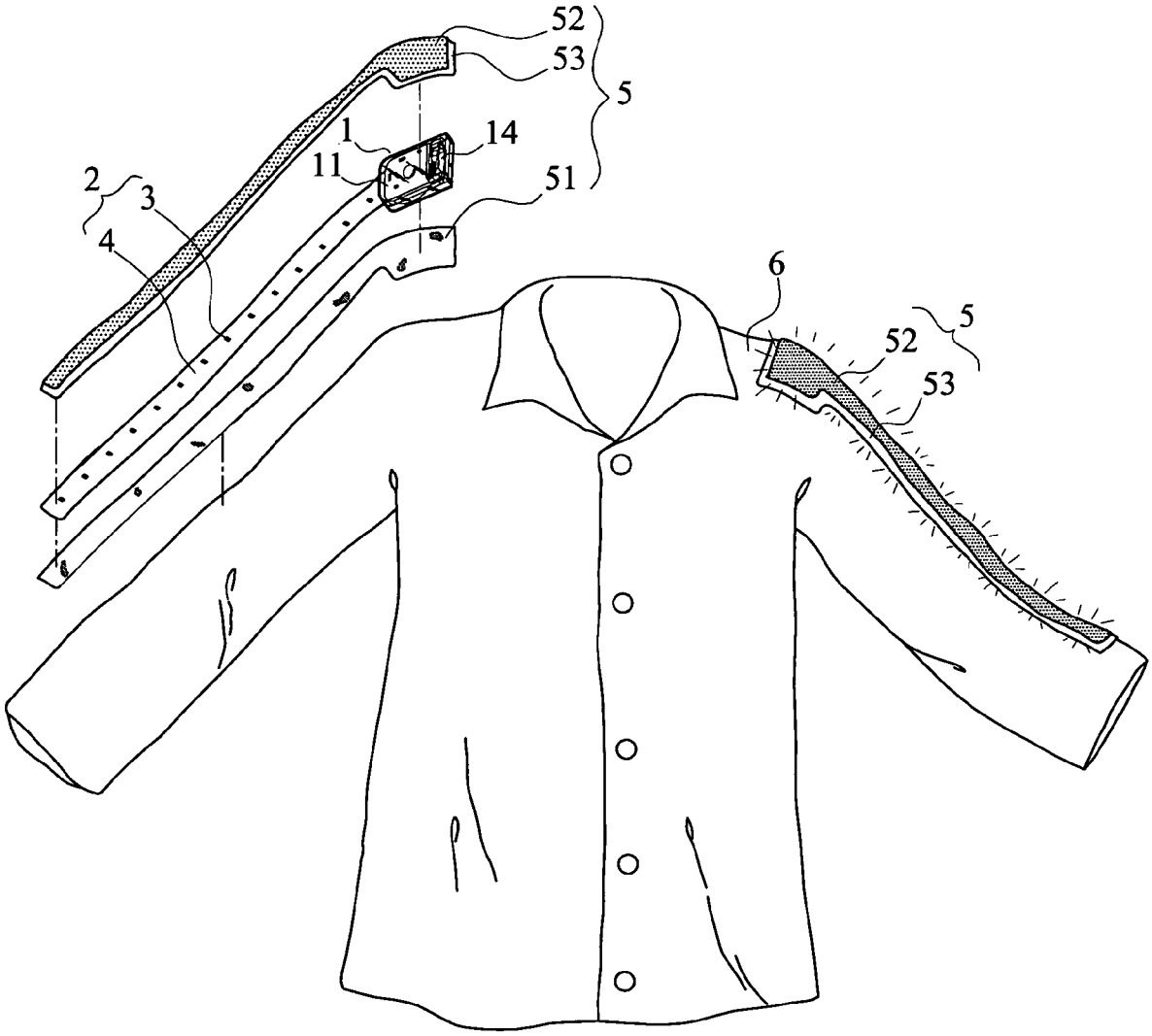
FIG. 8: is a schematic view of the module of the first embodiment coupled to a garment.
Figure 9:
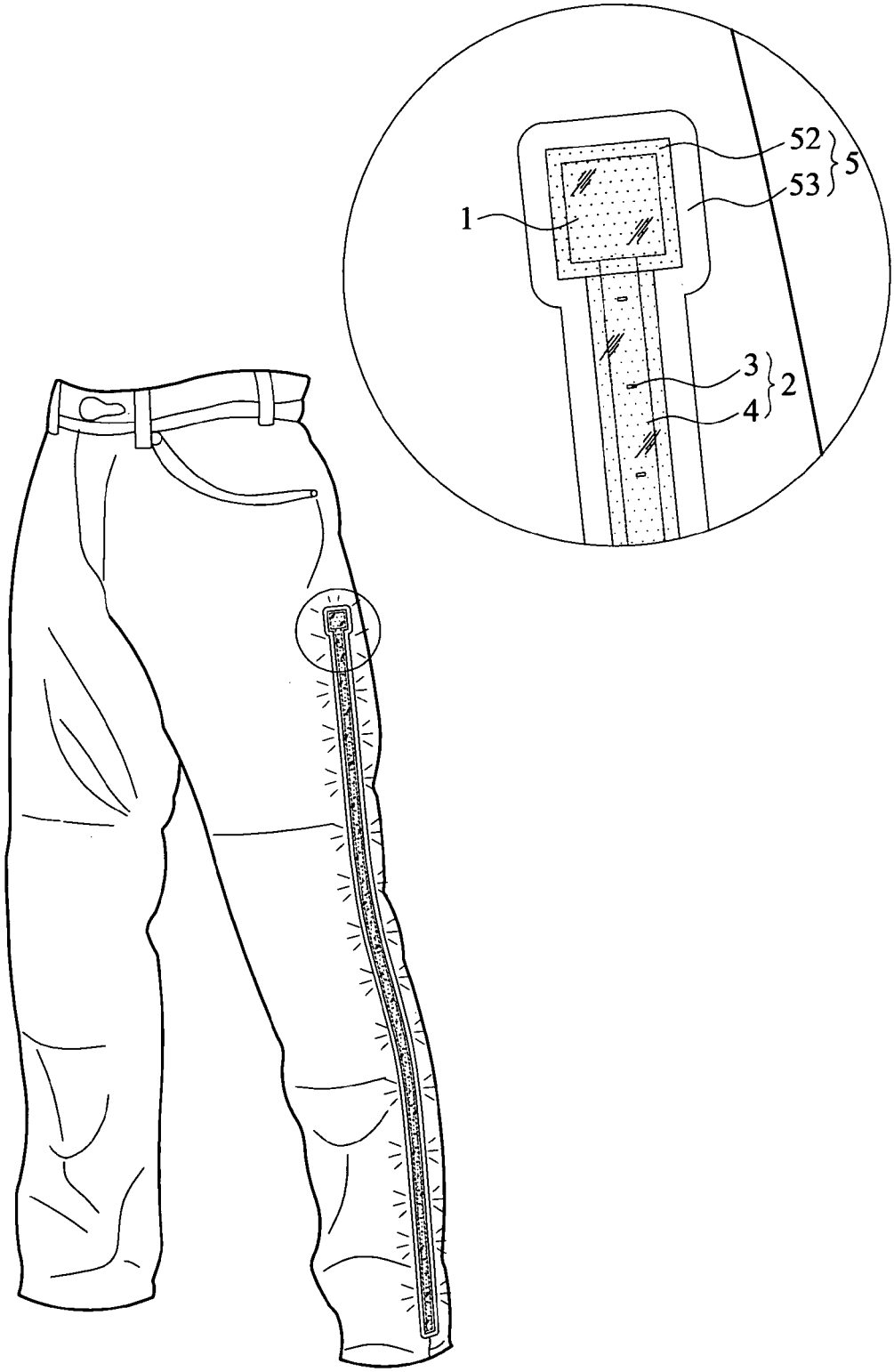
FIG. 9: is a schematic view of the module of the first embodiment coupled to a pair of trousers.

As shown in FIGS. 8 and 9, said light emitting device (2) of the first embodiment is combined by said membrane circuit (3) with said SMD LEDs (4). Said light emitting device (2) is stretched straight as long strip. When applied to said object (6) includes either said garment of FIG. 8 or said pair of trousers of FIG. 9, upon which being adorned with said light emitting device (2) to enhance light effect with subsequent protracted light emissions. The same decorated on reflection safety vests for traffic policemen allow them stay safe during peak hour. Or for construction workers allow them run errands in their building site.

Figure 13:
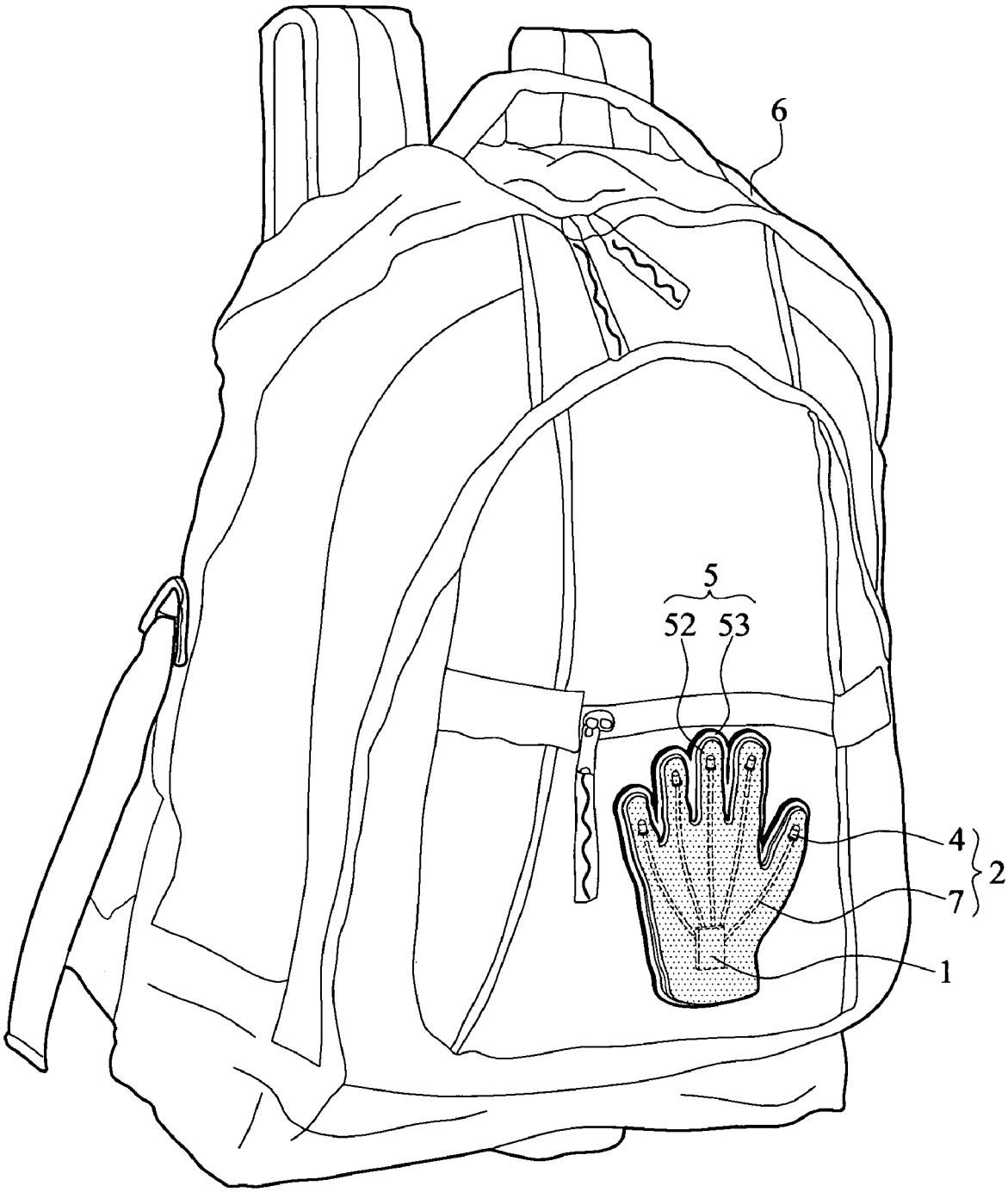
FIG. 13: is a schematic view of the module of the second embodiment coupled to a backpack.

While the second embodiment of the present invention, said sets of leading wires (7) electrically connected to the LEDs (4), but not SMD LEDs, separately, where different light emissions from the light emitting devices (2) coupled to the pouch (5) show glittering light effect (as shown in FIG. 13), further the light emitting device (2) can be dimensioned conformed to the size of the pouch (5). That is different from monotonous, light dim of those conventional light emitting device in use for a longer while.

ADVANTAGES OF EMBODIMENTS OF THE PRESENT INVENTION

By embodiments of the present invention advantages and benefits can be achieved as following:

Variable performances of said light emitting devices (2) of the present invention can be used as stretched straight long strip to enhance light effect with subsequent protracted light emissions; or separate light emissions by pairs of leading wires connected to LEDs with glittering light effect.

Both said control unit (1) and said light emitting device (2) are sealed inside the pouch (5), perimeters (53) of which are sealed tightly by high frequency wave or sewing. Water vapor or moisture could not seep through objects into the pouch (5).

Further, since said control unit (1) and said light emitting device (2) are already disposed inside the pouch (5), they are combined as a whole. Either the pouch (5) is sewn to the objects (6) by sewing, or coupled to the objects (6) by high frequency wave, the pouch (5) decorated on the objects can be coupled with the objects in place in one step.

Moreover, since the control unit (1) and the light emitting device (2) are fixed inside the pouch (5) without any movements. Even in the pouch (5) filled with nitrogen or inert gas in comparison with ambient air with a concentration from 30% up to 70% for accident-preventive purpose, the control unit (1) and the light emitting device (2) can be located in position without any displacements.

Besides, metal ball of said ball-rolling switch (14) subject to feeble vibration can be activated to roll on said clamping plate (141). Further, the rolling ball is in contact with said anode, cathode conduction portions (144, 145) at the same time. Whereby, said IC processor (16) is electrified to light said LEDs (4). Such said ball-rolling switch (14) is more responsive than conventional reed switch.

What is claimed is:

1. A responsive light emitting diode (LED) module unit comprising a control unit (1), a light emitting device (2), and a pouch (5) for enclosing said control unit (1) and said light emitting device (2) therein;

said control unit (1) includes a printed circuit board (PCB) (11), a battery (12) disposed below the PCB (11) is electrically connected to the PCB (11), a ball-rolling switch (14) clamped and welded on an indentation formed at a distal end of the PCB, an integrated circuit (IC) processor (16) disposed on the PCB (11), said control unit (1) is built inside a rigid plastic housing (15);

said light emitting device (2) has a membrane circuit (3) electrically connected to the PCB (11), and a plurality of surface mounted device (SMD) LEDs (4) disposed on a first side of said membrane circuit (3) emit light triggered by said control unit (2); characterized in that:

said pouch (5) is composed of a soft polycarbonate base (51) and a soft polycarbonate cover (52) with surface decoration patterns; both perimeters (53) of said base (51) and said cover (52) are sealed by high frequency wave to form a hollow cavity (54) for receiving and fixing said control unit (1) and said SMD LEDs (4), further the sealed perimeters (53) are coupled to an upper surface of an object (6);

said pouch (5) wraps over said control unit (1), further wraps over said, at least, one light emitting device (2) respectively.

2. The responsive LED module unit of claim 1 wherein said pouch (5) is filled with nitrogen or inert gas (9) so as to inflate said cover (52) to slow down impacts on the pouch (5).

3. The responsive LED module unit of claim 1 wherein said ball-rolling switch (14) includes a clamping plate (141) electrically connected to said PCB (11), a housing (142) covers up said clamping plate (141); and, at least, one ball (143) disposed inside the housing (142) is electrically in contact with a superficial circuit laminate on the clamping plate (141); a plurality of pairs of anode, cathode conduction portions (144, 145) are equidistantly arranged on a surface of the clamping plate (141) in parallel to one another formed as said superficial circuit laminate.

4. The responsive LED module unit of claim 1 wherein said rigid plastic housing (15) is composed of a plastic cover (151), and a plastic base (152); the plastic cover (151) is relative to the plastic base (152); both the plastic cover (151) and the plastic base (152) are molded-to-shape.

5. The responsive LED module unit of claim 1 wherein said rigid plastic housing (15) is composed of a case (153) with a top opening, and a cap (154) for covering said top opening.

6. The responsive LED module unit of claim 1 wherein said control unit (1) is encapsulated by epoxy injection first to wrap over and then the injected epoxy is solidified as said rigid plastic housing (15).

7. A responsive LED module unit comprising a control unit (1), a light emitting device (2), and a pouch (5) for enclosing said control unit (1) and said light emitting device (2) therein;

said control unit (1) includes a PCB (11), a battery (12) disposed below the PCB (11) is electrically connected to the PCB (11), a ball-rolling switch (14) clamped and welded on an indentation formed on a distal end of the PCB (11), and an integrated circuit (IC) processor (16) are disposed on the PCB (11), said control unit (1) is built inside a rigid plastic housing (15);

said light emitting device (2) has, at least, a set of leading wires (7) includes leading wires (71, 72) respectively connected to anode and cathode of, at least, one light emitting diode (LED); light emissions of the light emitting device (2) are triggered by the control unit (1); characterized in that:

a pouch (5) is composed of a soft polycarbonate or polyvinyl chloride base (51), and a soft polycarbonate or polyvinyl chloride cover (52) with surface decoration patterns; perimeters (53) of said base (51) and cover (52) are sealed by high frequency wave to form a hollow cavity (54) for receiving and fixing said control unit (1) and said LEDs (4), further the sealed perimeters (53) are coupled to an upper surface of an object (6).

8. The responsive LED module unit of claim 7 wherein said nitrogen or inert gas (9) filled in the pouch has a concentration from 30% up to 70% in comparison with ambient air.

9. The responsive LED module unit of claim 7 wherein said leading wires (7) used as lead-out wires outside said rigid plastic housing, said LEDs (4) separately connected to the rigid plastic housing as far as each pair of the leading wires extended in between.

10. The responsive LED module unit of claim 7 wherein said control unit (1) is encapsulated by epoxy injection first to wrap over and then the injected epoxy is solidified as said rigid plastic housing (15).

11. A responsive LED module unit comprising a control unit (1), a light emitting device (2), and a pouch (5) for enclosing said control unit (1) and said light emitting device (2) therein;

said control unit (1) includes a printed circuit board (PCB) (11), a battery (12) disposed below the PCB (11) is electrically connected to the PCB (11), a ball-rolling switch (14), and an integrated circuit (IC) micro processor (16) are disposed on the PCB (11), and all the components as above are built inside a rigid plastic housing (15);

said light emitting device (2) has, at least, a set of leading wires (7); light emission of the light emitting device (2) is controlled by the control unit (1); characterized in that:

a pouch (5) is composed of a soft polycarbonate or polyvinyl chloride base (51), and a soft polycarbonate or polyvinyl chloride cover (52) with surface decoration patterns; perimeters (53) of said base (51) and cover (52) are sealed by high frequency wave to form a hollow case (54) for receiving and fixing said control unit (1) and said LEDs (4) in between, further the sealed perimeters (53) is coupled to an upper surface of an object (6).

12. The responsive LED module unit of claim 11 wherein said perimeters of said pouch (5) coupled to an upper surface of said object (6) by sewing.

13. The responsive LED module unit of claim 11 wherein said rigid plastic housing (15) is composed of a plastic cover (151), and a plastic base (152); the plastic cover (151) is relative to the plastic base (152); both the plastic cover (151) and the plastic base (152) are molded-to-shape.

* * * * *